US005142459A

United States Patent [19]

Swarens et al.

[11] Patent Number: 5,142,459

[45] Date of Patent: Aug. 25, 1992

[54] HIDDEN SOURCE FLUORESCENT LIGHT WASH FIXTURE

[76] Inventors: Ralph W. Swarens, 1830 Olivewood St., La Verne, Calif. 91750; Anatoly Kudishevich, 7214 Fountain Ave. #204, Los Angeles, Calif. 90046

[21] Appl. No.: 736,924

[22] Filed: Jul. 29, 1991

[51] Int. Cl.[5] ..... F21V 7/12

[52] U.S. Cl. ..... 362/217; 362/320; 362/347; 362/433

[58] Field of Search ..... 362/147, 217, 260, 296, 362/320, 347, 364, 433

[56] References Cited

U.S. PATENT DOCUMENTS

| | | | |
|---|---|---|---|
| 3,654,471 | 4/1972 | Nilsson | 362/320 |
| 4,061,422 | 12/1977 | Geurts et al. | 362/320 |
| 4,460,942 | 7/1984 | Pizzuti et al. | 362/320 |
| 4,517,631 | 5/1985 | Mullins | 362/347 |
| 4,564,888 | 1/1986 | Lewin et al. | 362/147 |
| 4,592,285 | 6/1986 | Egli | 362/320 |
| 4,748,543 | 5/1988 | Swarens | 362/147 |

*Primary Examiner*—Richard R. Cole
*Attorney, Agent, or Firm*—J. E. McTaggart

[57] ABSTRACT

A fluorescent indirect lighting fixture of the hidden source offset reflector type incorporates a novel reflector mounting system which provides advantages of extended uniform "wash" illumination with unusual concealment of the light source from direct view, along with extremely easy reflector installation and replacement. The reflector, formed to the required special curvature from a thin sheet of suitable metal such as high purity aluminum, is sprung into place between two opposite edges of a window opening in the metal fixture housing in a tongue-and-groove type engagement along the two edges where it is retained in place by the resilience of the reflector with no need for adhesives, screws or other fastenings. Illumination coverage and lamp concealment are both maximized by configuring the reflector and its mounting system uncompromisingly such that both of the straight end regions of the curved reflector extend smoothly and fully to a plane flush with the surrounding ceiling or wall surface.

6 Claims, 4 Drawing Sheets

HIDDEN SOURCE FLUORESCENT LIGHT WASH FIXTURE

FIELD OF THE INVENTION

The present invention relates to the field of lighting fixtures, more particularly to improvements in compact indirect fluorescent lighting fixtures of the offset hidden source type for illuminating selected flat surfaces in commercial and residential buildings.

BACKGROUND OF THE INVENTION

U.S. Pat. No. 4,748,543, for a HIDDEN SOURCE FLUORESCENT LIGHT WASH FIXTURE issued in 1988 to R. Swarens, contains background information and prior art references relevant to the present invention: that patent and the present invention address offset hidden source type lighting fixtures designed especially for the purpose of providing architecturally distinctive indirect lighting treatments wherein a fixture (or row of side-by-side fixtures), flush mounted into a flat surface such as wall or ceiling of a room, "washes" a nearby flat surface such as a wall, floor or ceiling, perpendicular to the mounting surface, with uniform illumination.

In the abovementioned patent a thin flexible offset reflective lining is adhesively attached to a rigid aluminum reflector mounting body extruded in a special compound curved shape having an offset lamp-surround portion blending into an extended "throw" portion so as to provide uniform "wash" illumination from the fluorescent lamp concealed within the lamp-surround portion.

Further development and marketing of this type of lighting fixture has led to the invention of an alternative reflector configuration and associated mounting system for an improved "wash" lighting fixture of the offset hidden source type, based on refinements of the optical principles of U.S. Pat. No. 4,748,543, but providing new benefits with regard to illumination coverage, producibility, and reflector replaceability.

It is particularly important to suppress spurious highlights reflected from parts of the housing around the window opening and to fully shield the source from direct view while at the same time providing maximal uniform area of "wash" illumination from a close-in fixture location.

Easy removal and replacement of the reflector, providing access to the ballast and wiring, is of benefit in manufacture, field installation and maintenance. Since it is usually preferred to operate this type of fixture without any protective window for optical and aesthetic excellence, there is further advantage in making the reflector easily replaceable.

OBJECTS OF THE INVENTION

It is a primary object of the present invention to configure a lighting fixture of the fluorescent offset-reflector hidden-light-source wall-wash type which will provide substantially uniform illumination along with an unusual degree of excellence in the shielding of direct light from the source and in the suppression of spurious highlights reflected from fixture surfaces.

It is a further object to provide, in a light fixture of the above-stated type, a reflector mounting configuration in which the specially shaped curved reflector is secured to the fixture in a manner which enables the reflector to be easily installed, removed and replaced, and which also provides the unique curved reflector surface shape required in this type of fixture, uniformly and reliably.

It is still a further object that the reflector be self-supporting and not require the use of a separate mounting body structural part.

SUMMARY OF THE INVENTION

The above objects have been met in the present invention of an improved fixture of the above-stated type incorporating a unique reflector mounting system in which two specially formed straight edges of the reflector engage two correspondingly formed edges of a window opening of a metal housing. The curved sheet metal reflector is fabricated from specially selected sufficiently springy material such as high purity aluminum which may be formed to a predetermined curved shape, which will withstand temporary deformation during installation and removal, and which will remain in place reliably, supported by its own resilience between the two opposed mounting edges formed in the housing window opening.

Compared to the above cited patent and other known art of this type, the fixture of the present invention provides both a larger field of effective illumination and an exceptional degree of lamp shielding due to refinements in the shape of the reflector, particularly at the two opposed straight edge regions which are made to extend effectively to the plane of the surrounding ceiling or wall surface.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
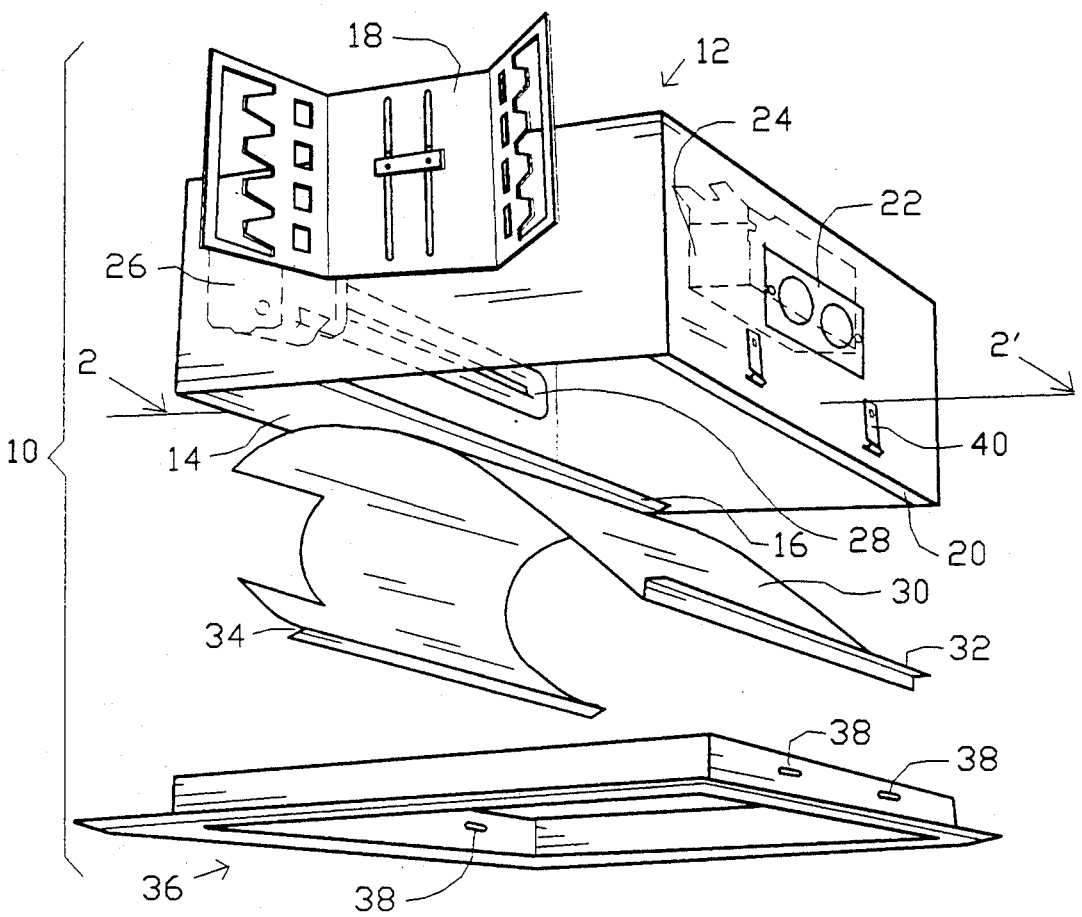
FIG. 1 is a three-dimensional partially exploded view of a lighting fixture according to a preferred embodiment of the present invention.

FIG. 1 shows a three-dimensional partially-exploded view illustrating a preferred embodiment of a lighting fixture in accordance with the present invention. The fixture 10 is shown in a downwardly facing disposition, as in a ceiling installation, where it would be "roughed in" to the ceiling structure. The metal housing 12 is closed on top and provides a large light window opening at the bottom bordered along one side by a panel 14 having along its edge an upwardly inclined lip 16. Housing 12 is to be attached to the framing of the building by a hanger bracket 18; in "roughingin", the housing's leading bottom edge 20 and panel 14 are set flush with the lower surface of the ceiling. An electrical connection plate 22 with a pair of knockout holes is located on the outside of housing 12. Mounted inside housing 12 are a ballast 24 and a socket 26, shown in dashed lines, carrying a U-shaped fluorescent lamp 28.

The reflector 30, shown removed from housing 12, is made from a sheet of appropriate metal such as high purity aluminum formed into the special J-shaped curved cross-sectional shape as shown: the reflector's leading edge is formed with two bends to provide a Z-shaped cross section with an offset mounting flange 32 extending outwardly as shown, and the lamp-surround edge is formed with a single acute-angled bend to provide an outward-facing V-shaped mounting groove 34 as shown. The reflector 30 is notched, as indicated at the left hand side, as required to provide clearance around socket 26 during installation or removal of the reflector 30.

A trim frame 36 has flanges extending outward on all four sides from a four-sided collar portion which is provided with a pair of slots 38 on each of two opposite sides (three of the four are shown). The collar portion is dimensioned to fit around the outside of housing 12, and is held in place by four spring fastening clips 40 attached onto the housing as indicated by the visible clips 40.

Clips 40 are adapted to secure frame 36 in place with a detent action engaging slots 38 such the frame 36 may be removed without tools by simply pulling it downward.

Figure 2:
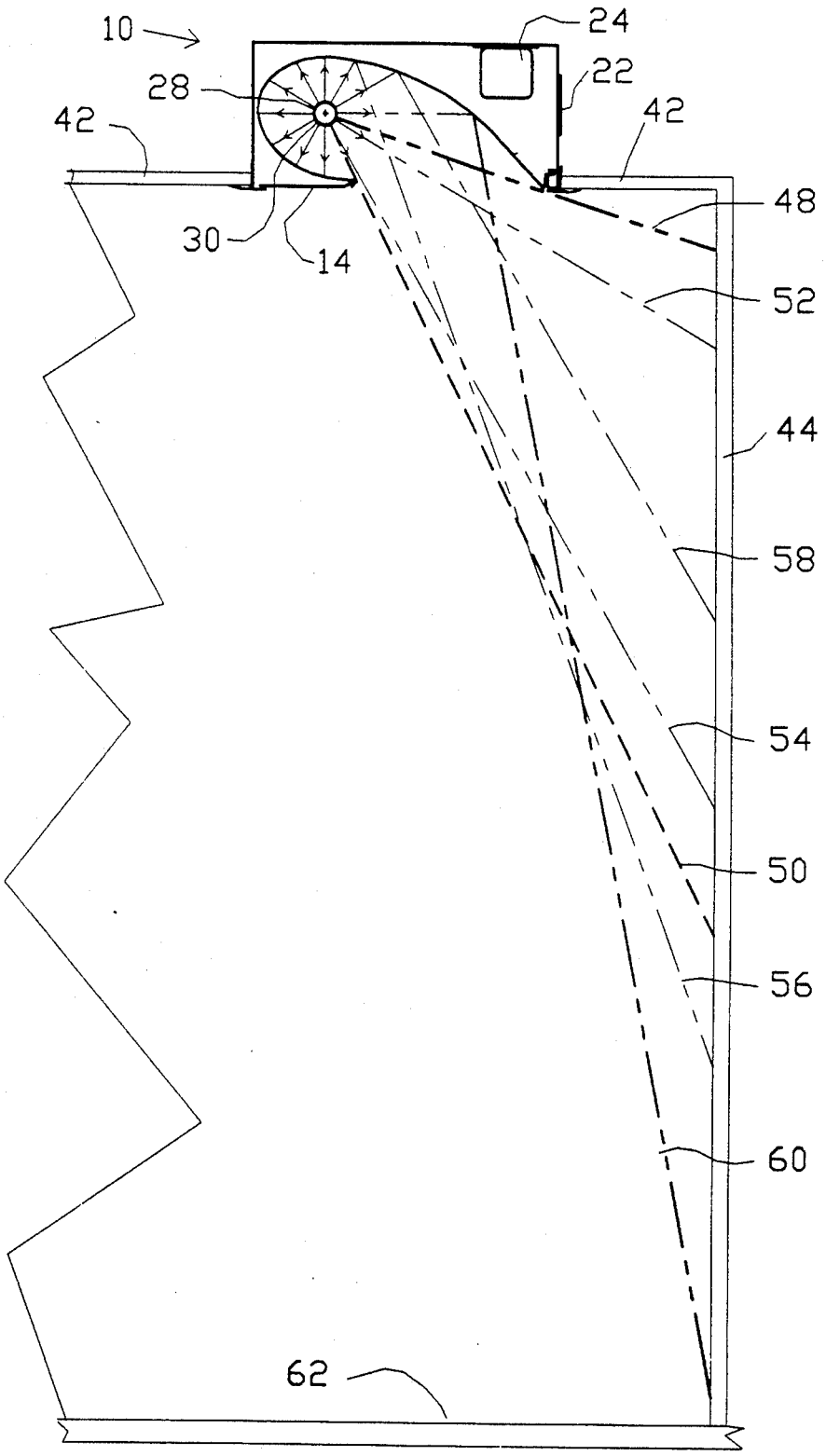
FIG. 2 is a cross section through a fixture of the present invention mounted in a ceiling, indicating the wall "washing" range and limit of lamp concealment.

FIG. 2 is a cross sectional view through axis 2-2' of FIG. 1, showing the fixture 10 of FIG. 1 in assembled form, mounted into a ceiling 42 and directed to an adjacent wall 44, to be "washed". The lamp 28 is shown as a single round tube; alternatively it could be the U-shaped type shown in FIG. 1. The locations of ballast 24 and electrical connection box 22 are indicated.

Amongst the light paths shown radiating from the lamp 28, two of these, paths 48 and 50, represent the boundaries of direct light from lamp 28 reaching the wall 44: these paths indicate the limits of the wall 44 which would receive direct illumination in the absence of reflector 30. It is desireable to locate the fixture 10 close to the wall 44 as shown so as to maximize the portion of the room area where the lamp 28 is concealed from normal view; however, the increased length of path 50 (2.17 times) and the large angle of incidence (70 deg.) compared to path 48 (18 deg.) would cause excessive variation in luminance with the lower portion inadequatedly illuminated (in the absence of a reflector). In this example, since luminance is inversely proportional to distance, the loss of luminance at the lower edge due to distance would be $1/(2.17\times2.17)=0.212$; and since luminance is proportional to the cosine of the angle of incidence the loss due to the angle of incidence would be $\cos 70/\cos 18=0.342/0.951=0.36$. Thus the total loss would be $0.212\times0.36=0.076$: the luminance at the bottom of the illuminated area would be only about 8% of that at the top.

Twelve additional radial light paths are shown at 30 degree intervals. Two of these paths, 52 and 54, represent direct radiation onto wall 44 between paths 48 and 50. Three others of the 12 paths, 56, 58 and 60, reflected once from the extension portion of reflector 30, are directed to the lower portion of wall 44 where they reinforce the direct illumination in this region; two of these paths, 56 and 60, extend the range of illumination downward well beyond the limit of direct illumination, i.e. path 50, to approximately the level of the floor 62. Seven remaining radial paths are indicated only in their initial unreflected portion to preserve clarity of FIG. 2; however analysis will show that mainly these will undergo two or more reflections before exiting through the light window, predominantly from the extension region, and will tend to ultimately reach the lower portion of wall 44 and further reinforce illumination in that region, but will have a negligible contribution to the upper portion of wall 44 in the region of path 48. Thus, with appropriate curvature and lamp location, reflector 30 acts in a manner to compensate for the inherent variation in the direct illumination and thus provide a wall "wash" illumination of acceptably uniform illumination. Configuring the mounting edges of the reflector 30 as shown so that they extend effectively to the surface plane of ceiling 42 acts to maximize both the range of "wash" coverage and the concealment of the source.

From the viewpoint of a person located anywhere in the room to the left of light path 50 shown as a dashed line, the lamp 28 would be shielded from direct view by panel 14; also, reflections from any part of the fixture 10 would be effectively suppressed.

Figure 3:
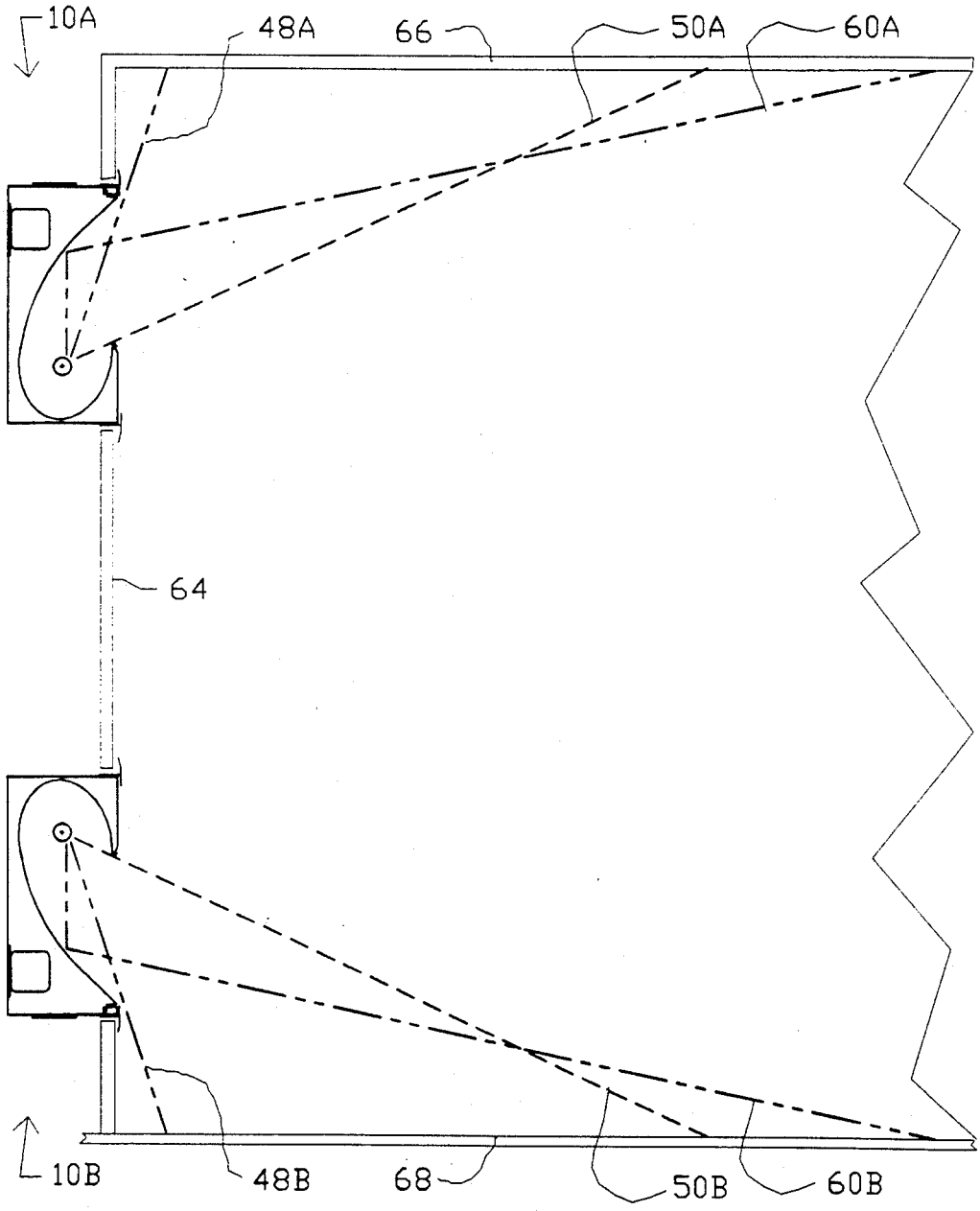
FIG. 3 is a cross-sectional view illustrating how fixtures of this invention may be mounted in a wall to provide floor and ceiling "washing" illumination.

FIG. 3 illustrates ceiling and floor "washing" from fixtures of this invention mounted in an adjoining wall: fixture 10A, mounted in an upwardly directed disposition near the top of wall 64, "washes" a ceiling 66 in the region bounded by limits 48A and 60A while concealing the lamp from any point of view below dashed line 50A, while fixture 10B, mounted in an upwardly directed disposition near the bottom of wall 64, "washes" the region of a floor 68 bounded by limits 60A and 60B while concealing the lamp from any point of view above dashed line 50B.

FIGS. 4A-4D show the steps in installing reflector 30 into housing 12 in initial assembly or following disassembly. It is assumed, with reference to FIG. 1, that the lamp 28 has not been inserted into socket 26 at the start of this sequence.

Figure 4A:
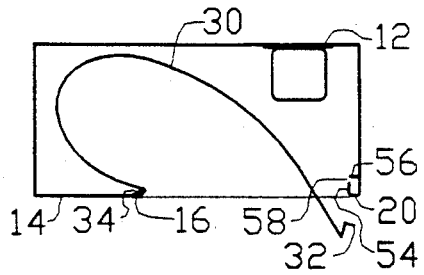
FIGS. 4A–4D show a sequential series of cross-sectional views illustrating steps in the installation of the reflector into the fixture of FIG. 1.

In FIG. 4A the reflector 30 is placed into the opening of housing 12 as shown, with the V-groove 34 at the lamp-surround edge engaging the lip 16 on panel 14 of housing 12. It is seen that, at the leading edge of housing 12, the bottom edge 20 is bent upwardly to form a ledge 54. A stop strip 56, which may be provided as a continuous strip (or alternatively as series of short tabs) is located slightly above and parallel to ledge 54 so as to form a channel 58 facing inwardly at the bottom leading edge of housing 12, to be utilized for mounting reflector 30.

Figure 4B:
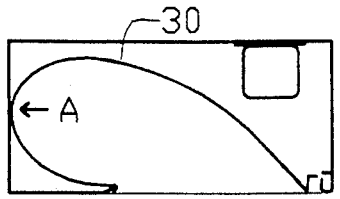

Then, in FIG. 4B, reflector 30 is pushed with two hands in the direction indicated by arrow A and held in that position.

Figure 4C:
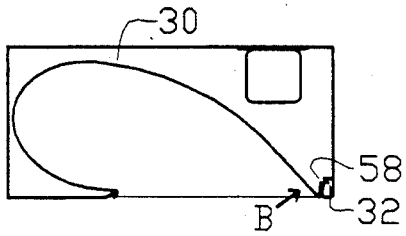
Figure 4D:
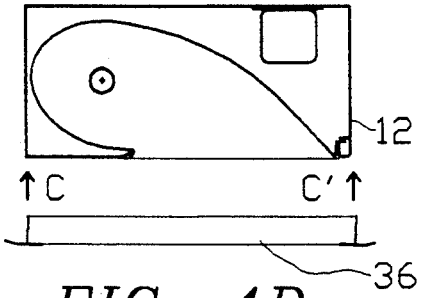

Then, in FIG. 4C, the reflector 30 is pushed with the thumbs in the direction indicated by arrow B so as to direct the reflector's leading edge flange 32 into mounting channel 58. Then the reflector 30 is released to its installed position as shown in FIG. 4D where it is retained in place by internal tension due to material resilience urging its edges apart against constraint of the housing 12. At this point (with reference to FIG. 1) the lamp 28 is inserted into the socket 26.

Finally the trim frame 36 is pushed upwardly, as indicated by arrows C in FIG. 4D, onto housing 12.

FIGS. 4E-4H show the steps in removing reflector 30 from housing 12: essentially the reverse of the steps in FIGS. 4A-4D.

Figure 4E:
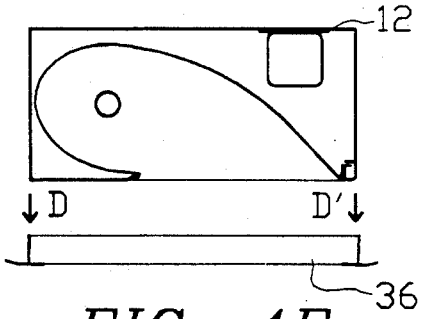
FIGS. 4E–4H show a sequential series of cross-sectional views illustrating steps in the removal of a reflector previously installed into a fixture as shown in FIGS. 4A–D.

In FIG. 4E, the trim frame 36 is pulled off downwardly as indicated by arrows D and removed from housing 12. Then, (with reference to FIG. 1) the lamp 28 is removed from the socket 26.

Figure 4F:
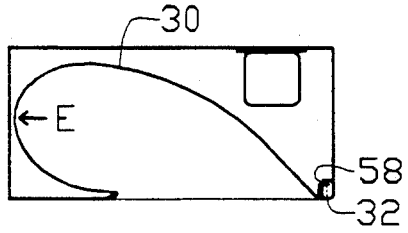
Figure 4G:
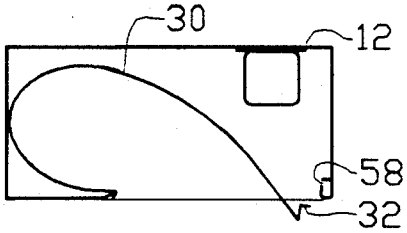

Then, as shown in FIG. 4F, reflector 30 is pushed with two hands in the direction of the arrow E so as to disengage and remove mounting flange 32 (at the lamp-surround edge of reflector 30) from mounting channel 58 of housing 12 as shown in FIG. 4G.

Figure 4H:
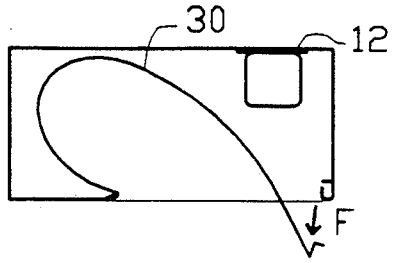

Finally, in FIG. 4H, the reflector 30 may be swung downwardly as indicated by arrow F and removed from housing 12.

Referring once again to FIG. 1, in the illustrative embodiment the specified "rough-in" dimension are 9" by 9", the trim frame is $10\frac{1}{4} \times 10\frac{1}{4}$, and housing 12 is made $8\frac{1}{2}$" by $8\frac{1}{2}$" by $3\frac{1}{2}$" deep, providing a window opening of 5 7/16" by $8\frac{1}{2}$". The lamp 28 is rated at 120 volts 13 watts (type #213 PLWW). Reflector 30 is shaped on a forming pattern to have a cross sectional shape as indicated in FIG. 2, and the lamp 28 is mounted in the relative position shown at a central focal point within the lamp-surround region. The unmounted shape of reflector 30 is made such that, with no spring bias, the span between mounting groove 32 and mounting flange 34 is approximately $\frac{1}{4}$" greater than the mounting span provided in the housing between mounting flange 16 and mounting channel 58, to provide a suitable amount of spring bias due to resilience as an expansive force to retain the reflector in place in its mounted position.

As an optional refinement, two reflective end plates may be provided, one at each end of the housing, attached to the inside of the housing end walls with double-sided adhesive foam material so as to urge the end plates against the two ends of the reflector.

The basic concept of this invention is readily adapted to other lamp styles and ratings, for example an alternative embodiment incorporates two of the U-shaped 13 watt lamps in line in a housing where the length is increased to 17".

As an alternative to the U-shaped fluorescent lamps shown, regular tubular lamps may be utilized, especially to provide higher wattage. For increased fixture length, multiple lamps may be designed into the fixture in a linear array. The basic reflector shape may be scaled in size, and fixtures may be supplied in various common nominal lengths such as 18", 2', 3', 4', etc.

Key elements in practicing the principle of the present invention, i.e. spring-biasing a resilient flexible reflector between two opposite edges of the light window, are the attachment means provided at each end. The illustrative embodiment of FIG. 1 utilizes a male member on the housing 12 in the form of the inclined flange 16 at the window edge, engaging a female member on the reflector 30 in the form of the groove 34 at the lamp-surround end, and, at the opposite edge, a female member on the housing 12 in the form of the window channel (58, FIG. 4A), engaging a male member on the reflector formed by the flange 32 at the extension end. The invention may be practiced with a number of equivalent alternative mating tongue-and-groove type attachment approaches; for example, male members at the two reflector ends could be made to engage female members on the two opposite housing window edges, or female members at the two reflector ends could be made to engage male members on the two opposite housing window edges.

The housing may be formed entirely from sheet metal such as steel or the major portion surrounding the reflector and defining its mountings may be extruded from aluminum.

The ballast transformer and associated wiring may be enclosed by a sheet metal baffle plate in compliance with electrical safety requirements.

The reflective surface of the mirror may be highly polished or finely diffused, and may be color-tinted for special effect.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An improved fluorescent lighting fixture of an offset-reflector concealed-lamp type for uniformly illuminating a flat surface such as a wall, floor or ceiling of a room while minimizing user-perceptable extraneous light in a vicinity of the fixture itself, comprising:

a housing, having walls enclosing a region including a lamp-surround region, having a substantially rectangular light window opening offset from the lamp-surround region, the light window having a first edge adjacent the lamp-surround region;

a reflector made from a substantially rectangular sheet of thin flexible resilient metal having a smooth highly reflective surface, formed to have a cross-sectional shape approximating a letter J with a curved lamp-surround portion adjoining and blending into a gradually curved extension portion, the reflector having a first straight edge bounding the lamp-surround portion and a second straight edge, parallel to the first straight edge, bounding the extension portion;

an elongated fluorescent lamp, supported by a socket attached to said housing and electrically energized via the socket from a source of electric power including ballast means, the lamp being disposed within the lamp-surround region of the housing substantially parallel to the straight edges of the reflector; and reflector mounting means comprising a first fastening member, disposed along said first straight edge of said reflector, mated with a complementary second fastening member disposed along said first edge of the light window, and a third fastening member disposed along said second straight edge of said reflector, mated with a complementary fourth fastening member disposed along a second edge of the light window opposite the first edge thereof, whereby said reflector is caused to become constrained between the two opposite edges of the light window, the reflector being preshaped to a predetermined oversize dimension so as to exert an expansive force against the two opposite edges of the light window and thus removably retain the reflector in place in an installed disposition with said lamp disposed within the lamp-surround portion of said reflector.

2. The lighting fixture as defined in claim 1 wherein the cross-sectional shape of said reflector forms a continuously concave curve having a generally elliptical shape in the lamp-surround portion, transitioning smoothly to a generally parabolic shape in the extension portion, said lamp being mounted at a focal location within the lamp-surround region so as to produce substantially uniform illumination over a targeted flat surface area perpendicular to a plane of the light window, while direct light and images of said lamp are concealed from ordinary observation by obstruction introduced by an edge portion of said reflector in the lamp-surround region.

3. The lighting fixture as defined in claim 1 further comprising a trim frame adapted to aesthetically interface said housing with building structure such as a wall or ceiling surrounding said housing, said trim frame comprising:

a collar portion adapted to engage a portion of the housing walls, said trim frame being provided with fastening means adapted to removably secure said trim frame to said housing, and a trim flange portion, perpendicular to the collar portion, extending outward beyond said housing around all four sides thereof so as to bear against a surface such as that of a wall or ceiling.

4. The lighting fixture as defined in claim 1 wherein said reflector mounting means comprises:

as the first fastening member, a V-shaped mounting groove defined by an outwardly-facing flange formed at an acute angle along the first straight edge of said reflector;

as the second fastening member, an inclined mounting flange formed in said housing along the first edge of the light window, the inclined flange being adapted to engage said V-shaped mounting groove;

as the third fastening member, an offset flange extending from said reflector along the second straight edge thereof; and as the fourth fastening member, an inwardly facing channel disposed along the second edge of said light window opposite the first edge thereof, the channel being formed between a ledge member and a stop member parallel to the ledge member, the channel being adapted to engage said offset flange.

5. A method of assembling a reflector to a housing of a fluorescent "wash" lighting fixture of an offset-reflector hidden-source type, the reflector being formed from a thin rectangular sheet of flexible resilient sheet metal to have a cross-sectional shape similar to a letter J, having an inwardly offset mounting flange extending along a first straight edge in a region of the reflector corresponding to a top end of the letter J and having a V-shaped mounting groove defined by an acute-angled flange formed to extend outwardly along a second straight edge opposite the first straight edge, the housing having in a flat rectangular side thereof a rectangular light window having along one edge thereof a mounting channel and having along an opposite edge thereof a mounting flange, spaced from the mounting channel by a distance less than the distance between the groove and the flange of the reflector, the method comprising the steps of:

(1) engaging the mounting groove of the reflector with the mounting flange of the housing;

(2) moving the reflector into the housing while urging its two straight ends toward each other so as to enable the mounting flange of the reflector to engage the mounting channel of the housing; and (3) releasing the reflector so as to engage its offset flange with the mounting channel of the housing so that the reflector thusly becomes mounted in a manner to be secured by spring bias of metal material of the reflector.

6. A method of removing a reflector from a housing of a fluorescent "wash" lighting fixture of an offset-reflector hidden-source type, the reflector being formed from a thin rectangular sheet of flexible resilient sheet metal to have a cross-sectional shape similar to a letter J with a straight portion and a curved lamp surround portion, the reflector having (a) an inwardly offset flange extending along a first straight edge of the reflector bounding the straight portion thereof, the offset flange engaging a mounting channel disposed along a first edge of a rectangular light window of the housing, and (b) a V-shaped mounting groove defined by an acute-angled flange formed to extend outwardly along a second straight edge of the reflector, opposite the first straight edge thereof and bounding the surround portion thereof, the mounting groove engaging a mounting flange disposed along a second edge of the light window opposite the first edge thereof, the reflector being retained in an operational disposition by an expansive force acting between the first and second edges of the light window due to elastic deformation of the reflector, the method of removing the reflector comprising the steps of:

(1) pressing the reflector in the surround portion thereof in a manner to disengage its offset flange from the mounting channel of the housing;

(2) pivoting the reflector about its second edge so as to swing its first edge outward away from the housing; and (3) disengaging the mounting groove of the reflector from the mounting flange of the housing; and (4) removing the reflector from the housing.

* * * * *